US009464868B2

(12) United States Patent
Monaghan

(10) Patent No.: US 9,464,868 B2
(45) Date of Patent: Oct. 11, 2016

(54) SHOOTING AID

(71) Applicant: John Patrick Monaghan, Athelstone (AU)

(72) Inventor: John Patrick Monaghan, Athelstone (AU)

( * ) Notice: Subject to any disclaimer, the term of this patent is extended or adjusted under 35 U.S.C. 154(b) by 0 days.

(21) Appl. No.: 14/831,918

(22) Filed: Aug. 21, 2015

(65) Prior Publication Data

US 2016/0054098 A1 Feb. 25, 2016

(30) Foreign Application Priority Data

Aug. 21, 2014 (AU) ..... 2014903281

(51) Int. Cl.
*F41G 1/10* (2006.01)
*F41G 1/54* (2006.01)

(52) U.S. Cl.
CPC .. *F41G 1/10* (2013.01); *F41G 1/54* (2013.01)

(58) Field of Classification Search
CPC ..... F41G 1/10; F41G 1/02; F41G 1/06; F41G 1/00; F41G 1/473
USPC ..... 42/141, 111
See application file for complete search history.

(56) References Cited

U.S. PATENT DOCUMENTS 217,770 A * 7/1879 Broden ..... F41G 1/473 42/141
752,962 A * 2/1904 Eby ..... F41G 1/473 42/141
1,205,756 A * 11/1916 Baron ..... F41G 1/473 42/141
1,313,549 A * 8/1919 Magill ..... F41G 1/473 42/141
1,421,553 A * 7/1922 Pohl ..... F41G 1/473 42/141
1,835,938 A * 12/1931 Ewen ..... F41G 1/473 42/144
2,056,469 A * 10/1936 King ..... F41G 1/473 42/140
2,386,420 A * 10/1945 Bailey ..... F41G 1/473 42/141
2,519,220 A * 8/1950 Bentley ..... F41G 1/473 42/141
2,730,806 A * 1/1956 Williams ..... F41G 1/473 42/141
2,904,888 A * 9/1959 Niesp ..... F41G 1/473 42/141
3,886,667 A * 6/1975 Rueb ..... F41G 1/473 42/141
5,067,244 A * 11/1991 Montalvo ..... F41G 1/473 42/141
7,328,531 B2 * 2/2008 Dietz ..... F41G 1/473 42/133
7,946,075 B2 * 5/2011 Nasef ..... H02G 3/0493 42/141
8,978,287 B1 * 3/2015 Riley ..... F41G 1/473 42/141
2013/0174465 A1 * 7/2013 Martinez Martinez . F41G 1/033 42/139
2015/0027027 A1 * 1/2015 Frederick ..... F41G 1/473 42/141

* cited by examiner

*Primary Examiner* — Joshua Freeman
(74) *Attorney, Agent, or Firm* — Defillo & Associates, Inc.; Evelyn A. Defillo

(57) ABSTRACT

There is provided a shooting training aid for a gun including a sight channel, a wing and connection member for connecting the shooting aid to the gun. The sight channel has a central vertical axis that extends substantially perpendicularly to an upper plane of the wing. There is also provided a gun mount training and gun-fit assessment methods using the shooting aid of the present invention.

5 Claims, 8 Drawing Sheets

SHOOTING AID

TECHNICAL FIELD

The present invention relates to a shooting aid for assisting a shooter to learn to consistently achieve a correct gun mount and to assist the shooter to achieve an acceptable gun fit. The invention has particular, but not exclusive application for use on shotguns.

BACKGROUND OF INVENTION

Shotguns are unlike many other long arms and handguns in that they are not intended to be sighted on the target using aligning sights located on the gun barrel. Rather, they are designed with the intention that when properly mounted to the shooter's body, they will shoot in the general direction that the shooter is looking. The shooter should have their visual focus on the target and not on the shotgun. The shooter needs to be confident that when the shotgun is fired, the swarm of shotgun pellets will be centred on, or slightly offset from, the target that is being focussed on.

To consistently hit targets, a shotgun shooter must be able to locate their shotgun in exactly the same spot relative to their body and dominant eye, each and every time. The dominant eye looks down the length of the barrel but with a focus on the actual target. If a consistent and correct gun mount is not achieved, then the shooter will not be able to reliably hit the target.

Shotguns are typically fired at moving targets, for example a clay target or a bird. This requires the shooter to coordinate movement of their body, gun and eyes all in relation to the moving target. The shotgun is fired whilst moving with the barrel aligned ahead (i.e. with lead) of the target's expected trajectory to allow for firing delay (i.e. lock time) and the distance the target will move as the shot travels the distance between the gun and the point of impact. The shooter will continue to move and swing the shotgun through as the shot is fired.

In order for the shooter's brain to calculate the range, speed and trajectory of the target, their eyes must be focussed on the target. In sport shooting such as sporting clay shooting, the shooter must sight the target and then swing their body together with the unmounted gun generally with the moving target. The gun is then mounted whereafter small trajectory adjustments are made by the shooter (for example to correct the lead) and then the shot is taken. This process is very complex and there are many parameters that need to be considered by the shooter. Further, there is only a very limited time to sight, mount the gun and shoot the target. Accordingly, one of the factors that will set good shooters apart from poor shooters is their ability to reliably correctly mount their shotgun. This firstly requires correct gun fit and once that is achieved, many hours of practice to establish consistently correct gun mount. A consistent gun mount reduces the number of variables to get the gun on target.

Gun-fit is established by checking factors such as cast, length of pull, drop, comb height, pitch angle and balance. When these factors are correctly set on the gun used by the shooter, the shooter is more likely to achieve comfort, gun movement control and eye-rib alignment leading to gun mounting consistency and hence accuracy in shooting. Correct gun-fit can be established by adjusting the shooter's gun to suit them. The adjustments made will depend on the shooter and the particular gun but may include adjustment of the comb, the cast, the stock, the butt and in some instances weights are included inside the stock for balance.

Some of the sights currently on the market include an adjustable sight that clamps onto the rib of a shotgun sold under the Allen® Turkey Taker Shotgun Sight brand. This removable sight does not however allow the shooter to determine whether the gun has canter or tilt left or right. Fiber optic tubes and scopes are also disclosed in the prior art, some of which include a dot that is aimed at the target, such as the Red Dot Sights sold under the Aimpoint® trademark, or a ring that is positioned around a target or part thereof, such as the sight sold under the Redring® trademark. Other shooting sights currently on the market includes a simple florescent strip that is attached down a length of the rib and sold under the SightRib™ trademark, as well as rigid sights that include a ring through which the shooter looks, such as the one sold under the XS® Backup Ghost-Ring trademark.

All of the devices currently available allow, to varying degrees, the shooter to determine vertically and horizontally the correct direction that the gun should be pointed, however none of the prior art allows the shooter to easily assess if the gun itself is being held with a correct gun mount and is not rolled sideways away from vertical.

The inventor is aware of some rudimentary devices and methods that have been used to provide a detachable shooting aid. One such method uses of a clothes peg attached to the rib of a shotgun, whereby the sight bead is viewed through the upwardly extending arms of the clothes peg to provide a rough indication of the position of the gun. Such rudimentary devices and methods have a number of issues including, but not limited to, keeping the longitudinal axis of the peg at right angles to the rib, the fact that the arms of the peg taper towards each other making it quite difficult to view the sight bead between the arms and securing the peg to the rib such that it does not dislodge while the shotgun is being swung up into position.

It is considered detrimental to look at the gun when aiming at a target such as a fast moving bird or a clay target. However, most sights are intended to be permanently fixed to the gun and the target viewed therethrough. Accordingly many such sights are not suitable for use in hitting such fast moving targets.

The present invention seeks in one aspect to provide a shooting aid arranged to assist the shooter to learn to consistently achieve correct gun mount. It is also envisaged that the invention in a second aspect may enable acceptable gun-fit to be assessed. The reader should appreciate that the present invention could be understood to comprise an aid for training the shooter to position their gun correctly, rather than a sight used in the processes of actually aiming at a target.

The discussion of the background to the invention herein is included to explain the context of the invention. This is not to be taken as an admission that any of the material referred to was published, known or part of the common general knowledge as at the priority date of this application.

SUMMARY OF INVENTION

According to a first aspect of the present invention there is provided a shooting aid for a gun including a sight channel, a wing and connection member for connecting the shooting aid to the gun, and wherein the sight channel has a central vertical axis that extends substantially perpendicularly to an upper plane of the wing.

In accordance with an embodiment of the invention, when the shooting aid is in use by a shooter, the sight channel and wing are visually located within the shooter's sight picture or line of sight.

The shooting aid is preferably arranged for removable connection to the barrel of the gun or to a rib of the gun barrel. The shooting aid is arranged to be positioned preferably to the rear of the barrel.

The sight channel preferably includes a base, a first inner side and a second inner side and the central vertical axis of the sight channel extends midway between the first inner side and the second inner side. The first inner side and second inner side are preferably formed as planar members and are parallel in a generally vertical direction.

The sight channel is provided to establish a correct view of the target only when the gun is correctly mounted and with the shooter's dominant eye properly focussed on the target. In this position, the shooter's dominant eye will see through the sight channel to the front bead of the barrel and in this position the shooter's eye is considered to be positioned correctly horizontally. When the shooter's dominant eye is also positioned correctly vertically, the front bead will be positioned above the base of the sight channel, wherein the front bead will appear to sit atop the base. Those skilled in the art will however recognise that such a setup is suitable for flat shooting guns. However, for shooting disciplines such as trap and skeet, gun setup will be slightly different. For example, the bead would sit higher to compensate for a fast rising clay.

In one form an insert or shim may be used to raise the base of the sight channel. Different sized inserts or shims having different thicknesses may be used to raise the base or floor of the sight channel to the desired extent. Preferably the insert or shim may be detachable mounted within the sight channel. In one form the insert or shim include depending resiliently deformable hooks at opposite ends to clip over the edges of the base or floor. The insert or shim may also be detachable mounted to the walls of the sight channel or to the wing, provided the line of sight of the shooter is raised by the desired amount off the base of floor off the sight channel.

If the shooter can comfortably adopt a gun mount enabling the front bead to be sighted sitting atop the base of the sight channel, acceptable gun-fit is considered to be achieved. Accordingly, gun-fit should be achieved by adjusting the gun until this can be achieved. In this manner, the shooting aid can be used to assess and ultimately achieve acceptable gun-fit for a shooter with that particular gun.

Once acceptable gun-fit is established, the shooting aid according to an embodiment of the invention can be used to help teach correct gun mount by examination of three references. The sight channel can be used to establish proper horizontal and vertical positioning of the dominant eye along the barrel and relative to the front bead. Further, the wing can be used to teach proper orientation of the actual gun against the shooter's body. Irrespective of the angle at which the target is located relative to the shooter's position, the gun mount should always be such to ensure that the vertical axis of the gun when shooting (i.e. the axis corresponding to the central longitudinal axis of the butt plate of the gun) is not rolled sideways away from vertical. This is particularly important for over and under type shotguns that have two barrels mounted one on top of the other.

Embodiments of the present invention provide a mechanism for the shooter to assess whether their gun is rolled sideways by examination of the positioning of the wing, which also forms part of their sight picture when their dominant eye is focussing on the target through the sight channel. If the wing extends horizontally, their gun is not rolled sideways. However, if the wing it tilted, then the gun is incorrectly positioned and their gun mount should be adjusted until the wing extends horizontally. By using the shooting aid to repeatedly check each of the three references after the shooter has mounted their gun, the shooter can be conditioned to consistently mount their gun to the same correct position (i.e. correct gun mount). To this end, it is envisaged that the shooter would correctly mount their gun with the assistance of the shooting aid, they would then try to repeat that motion without the gun mount or with their eyes closed, and would open their eyes and check their gun mount positioning with the shooting aid. This process would be repeated until correct gun mount is consistently achieved. This will later facilitate the shooter's ability to reliably hit targets, whether moving or stationary because they will adopt, without conscious thought, a correct gun mount whilst retaining focus on the target. The shooting aid according to an embodiment of the invention provides a mechanism to train the shooter's muscle memory to achieve correct gun mount.

In accordance with a preferred embodiment of the invention, the wing includes a first wing portion extending outwardly of a first outer side of the sight channel and in a particularly preferred embodiment includes a second wing portion extending outwardly of a second outer side of the sight channel. Each wing portion has a length dimension that extends generally parallel to the length of the barrel of the gun and a width dimension that extends generally perpendicular to the length of the barrel of the gun. The width dimension of the wing portion is preferably greater than the length dimension of the wing portion. The width dimension of each wing portion is what the shooter sees in their sight picture to make an assessment as to whether the gun is correctly orientated (i.e. rolled sideways away from true vertical).

Each of the wing portions preferably has a generally planar upper face that establishes the upper plane of the wing.

The connection member preferably includes first and second connection portions that define an opening for receiving a part of the gun. Preferably the shooting aid is attached to the rib that extends along the top of the upper barrel in an over and under type shotgun, or that extends above and parallel with the two barrels of a side by side type shotgun. The first and second connection portions are arranged to engage against the part of the gun, preferably the rib, when it is received in the opening so as to connect the shooting aid to the gun and to centre the shooting aid about the rib. The first and second connection portions are configured to press against and firmly hold the shooting aid to the part of the gun. The part of the gun located in the opening may be for example the barrel or preferably the rib of the gun.

The connection member may adopt other forms. For example the connection member may adopt the form of a clamping mechanism, spring type clips, a pin in aperture connection or any other connection or fitting that will hold the shooting aid to the gun in the required orientation during operation.

The connection member in one form includes projections that extend inwardly thereof inhibit the tilting of the shooting aid. The connection member may further include depending protrusions that taper toward a lower end such that the connection member is able to engage the rib of a shotgun without impinging upon the barrel therefore, especially in the case of a side-by-side barrel type shotgun.

According to a second aspect of the present invention there is provided a shooting aid for a gun including a sight channel and connection member for connecting the shooting aid to the gun, and wherein the sight channel has a central longitudinal axis arranged to extend substantially parallel to a longitudinal central axis of a barrel of the gun when the shooting aid is connected to the gun via the connection member.

In accordance with an embodiment of the second aspect of the invention, the sight channel preferably includes a base, a first inner side parallel and spaced apart from a second inner side and the central vertical axis of the sight channel extends midway between the first inner side and the second inner side. The first inner side and second inner side are preferably formed as planar members.

BRIEF DESCRIPTION OF DRAWINGS

Embodiments of the invention will now be described, by way of example only, with reference to the accompanying drawings in which.

DETAILED DESCRIPTION

Figure 1:
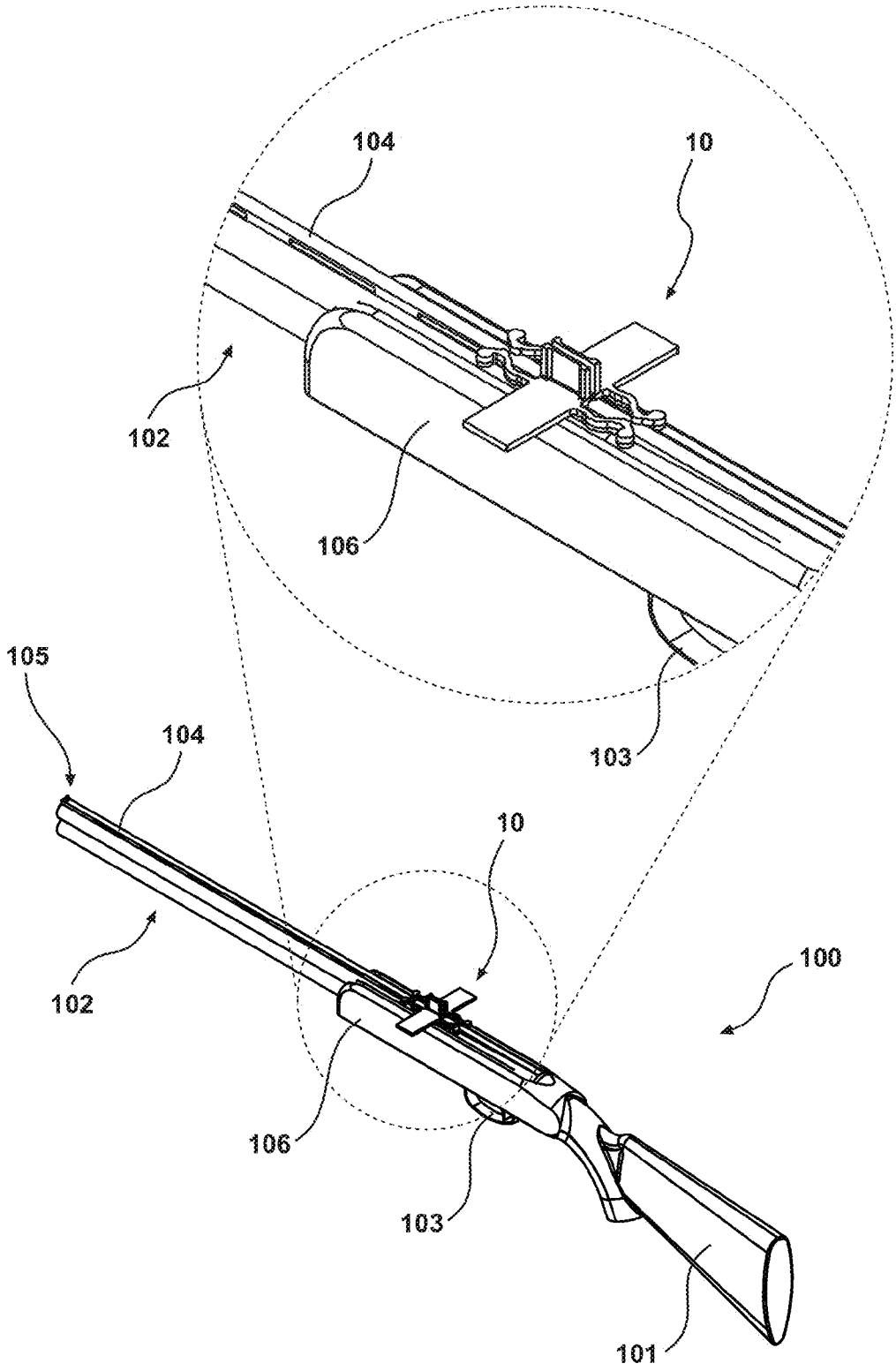
FIG. 1 is an isometric view of a shotgun fitted with a shooting aid in accordance with an embodiment of the first aspect of the invention, including an enlarged view of a portion of the shotgun further illustrating the attachment of the shooting aid to the rib.
Figure 2A:
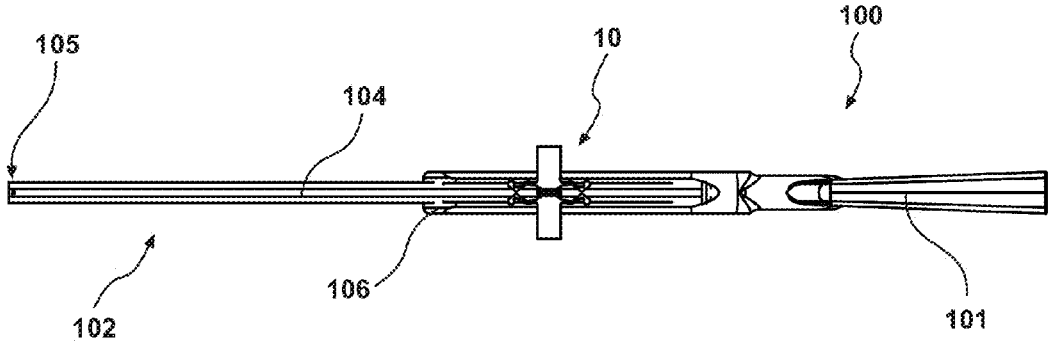
FIG. 2*a* is a top view of the shooting aid connected to the shotgun shown in FIG. 1.
Figure 2B:
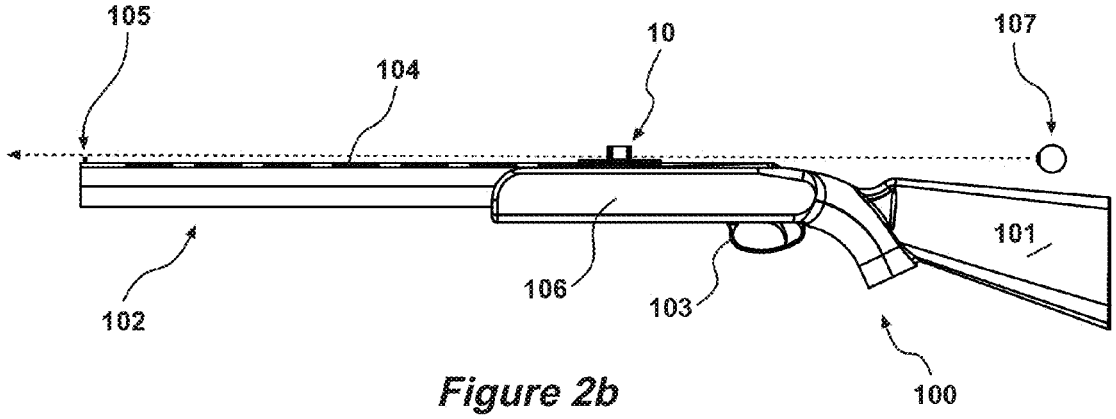
FIG. 2*b* is a side view of the shotgun and shooting aid of FIG. 1 illustrating the position of the shooter's eye and line of sight.

FIGS. 1 to 2*b* illustrate a shooting aid 10 according to an embodiment of the invention mounted on a shotgun 100. As more clearly shown in the enlarged portion of FIG. 1, the shooting aid 10 is connected to a shotgun 100 having a stock 101, barrel 102 and trigger 103, adjacent the rear end of the barrel 102 and is mounted on the rib 104 of the shotgun 100. A bead 105 is attached to a forward end of the rib 104. The shotgun 100 further includes a forestock 106, other components will not be described but will be known to the skilled addressee. The connection of the shooting aid 10 to the shotgun 100 will be described in more detail below.

FIG. 2*b* illustrates the relative position of the shooter's eye 107 when the gun is correctly mounted. The shooter's line of sight is illustrated in FIG. 2*b* by the broken arrow, which passes through the shooting aid 10 and over the top of the bead 105 mounted on rib 104.

As illustrated in FIGS. 3*a* to 4*c* the shooting aid 10 includes a sight channel 20, a wing 30 and connection member 40 for connecting the shooting aid 10 to the shotgun 100. The connection member 40 is preferably arranged to enable removable connection of the shooting aid 10 to the shotgun 100 and in this instance is formed as first and second connection portions 42, 44 that are arranged to effectively clip onto the rib 104 of the shotgun 100. Connection members 40 are located adjacent both ends of the sight channel 20, and the wing or wings 30 extend outwardly from both sides of the sight channel. The wing or wings 30 extend outwardly from both sides of the sight channel to assist the shooter in determining whether the shotgun is level relative the horizon, i.e. it is not canted sideways.

The connection members 40 are located adjacent both ends of the sight channel 20 so that the shooting aid 10 is held parallel to the rib 104 at all times. If there was only a single connection member there could be have a tendency to tilt. However the present invention is not limited to two connection members and a single connection member could be used without departing from the scope of the invention. For instance, a single connection member could extend across the length of the wing on an opposite side to the sight channel 20 and parallel thereto.

Figure 3A:
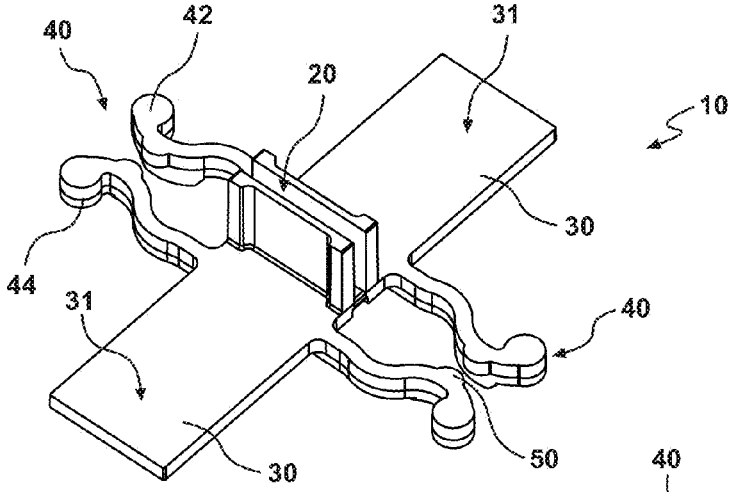
FIG. 3*a* is an isometric view of the shooting aid shown in FIG. 1.
Figure 3B:
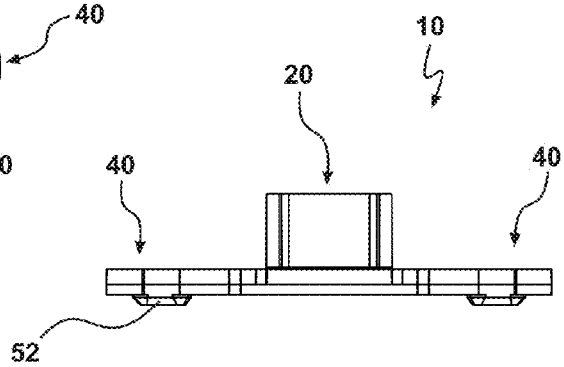
FIG. 3*b* is a side view of the shooting aid shown in FIG. 3*a;*

Furthermore, as illustrated in FIG. 3*a*, the connection members 40 include projections 50 that extend inwardly of the respective connection member 40 but do not extend to the same depth as the respective connection member 40. In this way the projections 50 bear on the top of the rib 104 and further inhibit the tilting of the shooting aid 10, which would affect its operation.

Figure 6A:
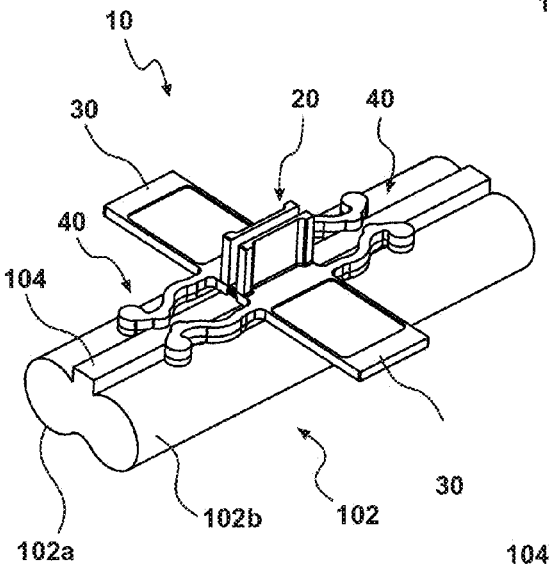
FIG. 6*a* is an isometric view of the shooting aid attached to a rib of a side-by-side double barrel shotgun.
Figure 6C:
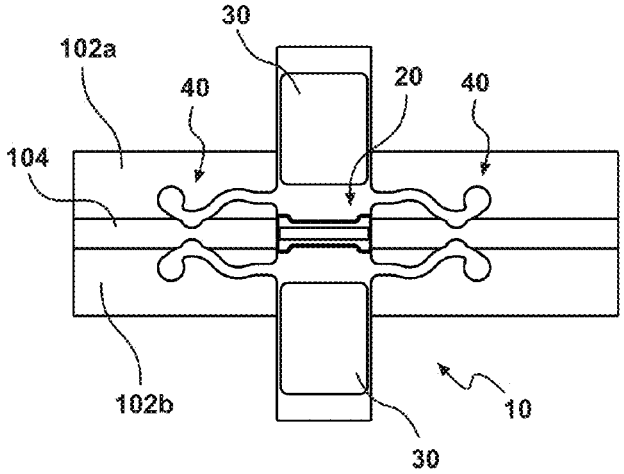
FIG. 6*c* is a top view of the shooting aid attached to the gun of FIG. 6*a;*
Figure 6B:
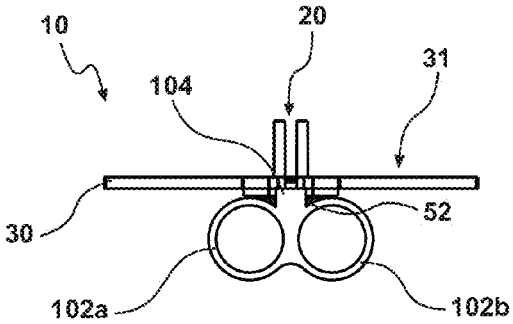
FIG. 6*b* is a front, end view of the shooting aid attached to the gun of FIG. 6*a;*

The connection members 40 also includes depending protrusions 52 that extending downwardly to ensure that the connection members 40 can be attached to the rib 104, especially in the case of side-by-side shotguns 100 as illustrated in FIGS. 6*a* and 6*b*. The depending protrusions 52 are taped inwardly toward a lower end as illustrated in FIG. 4*b*. This is to ensure the depending protrusions 52 avoid contact with the barrels 102*a* and 102*b*, as illustrated in FIG. 6*b*. This connection will be described in more detail subsequently.

As clearly illustrated in FIG. 4*b*, the sight channel 20 includes a base or floor 22, a first inner side 24 and a second inner side 26. The first inner side 24 and second inner side 26 are formed as generally planar members that extend parallel to and spaced apart from one another and perpendicular to the base or floor 22. The sight channel 20 has a central vertical axis S and a central longitudinal axis L.

Figure 4A:
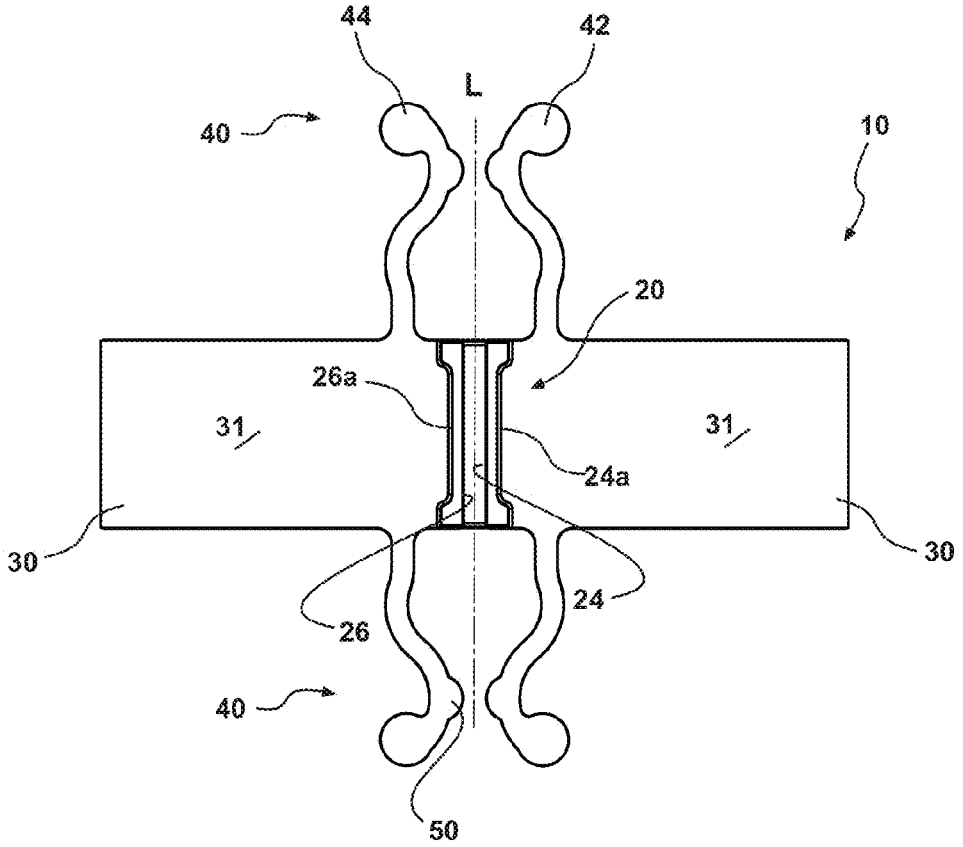
FIG. 4*a* is a top plan view of the shooting aid shown in FIG. 3*a*.
Figure 4B:
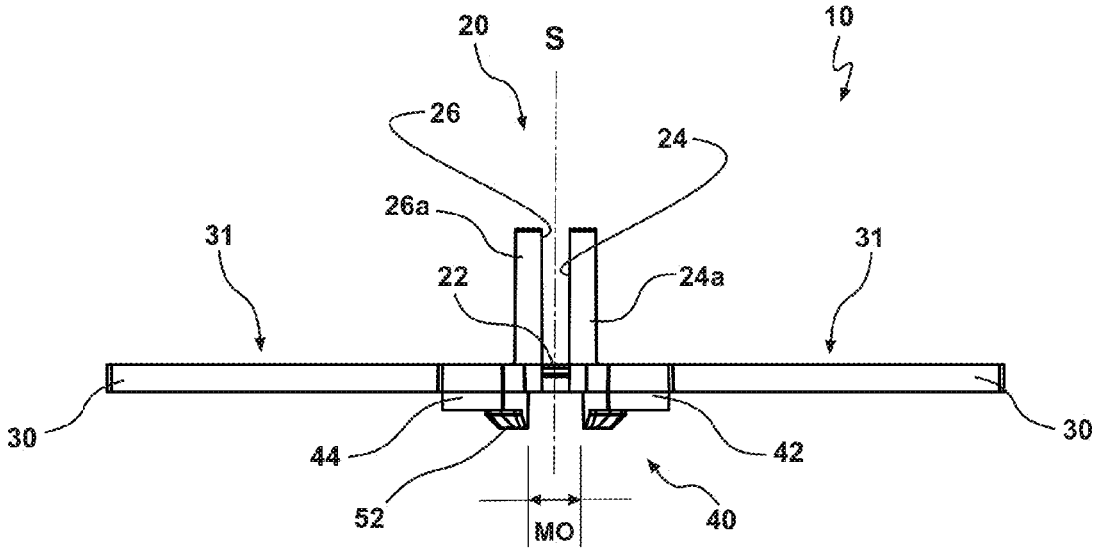
FIG. 4*b* is an end view of the shooting aid shown in FIG. 3*a;*

Wing 30 as illustrated is formed as a continuous wing that extends outwardly away from each outer side 24*a*, 26*a* of the sight channel 20 and perpendicular to the central longitudinal axis L of the sight channel 20, as illustrated in FIG. 4*a*. The continuous wing 30 extends below the base or floor 22 of the sight channel 20. However it is envisaged that the wing 30 may be formed as two wing portions, each wing portion extending from an associated outer sided 24*a*, 26*a* of the sight channel 20. In either case, the wing 30 includes upper faces 31 which are coplanar and which extend substantially perpendicular to the central vertical axis S of the sight channel S, as illustrated FIG. 4*b*. As will be explained later, these upper faces 31 provide the means for the shooter to assess using the shooting aid 10 whether the shotgun 100 is properly orientated without any sideways roll.

Figure 4C:
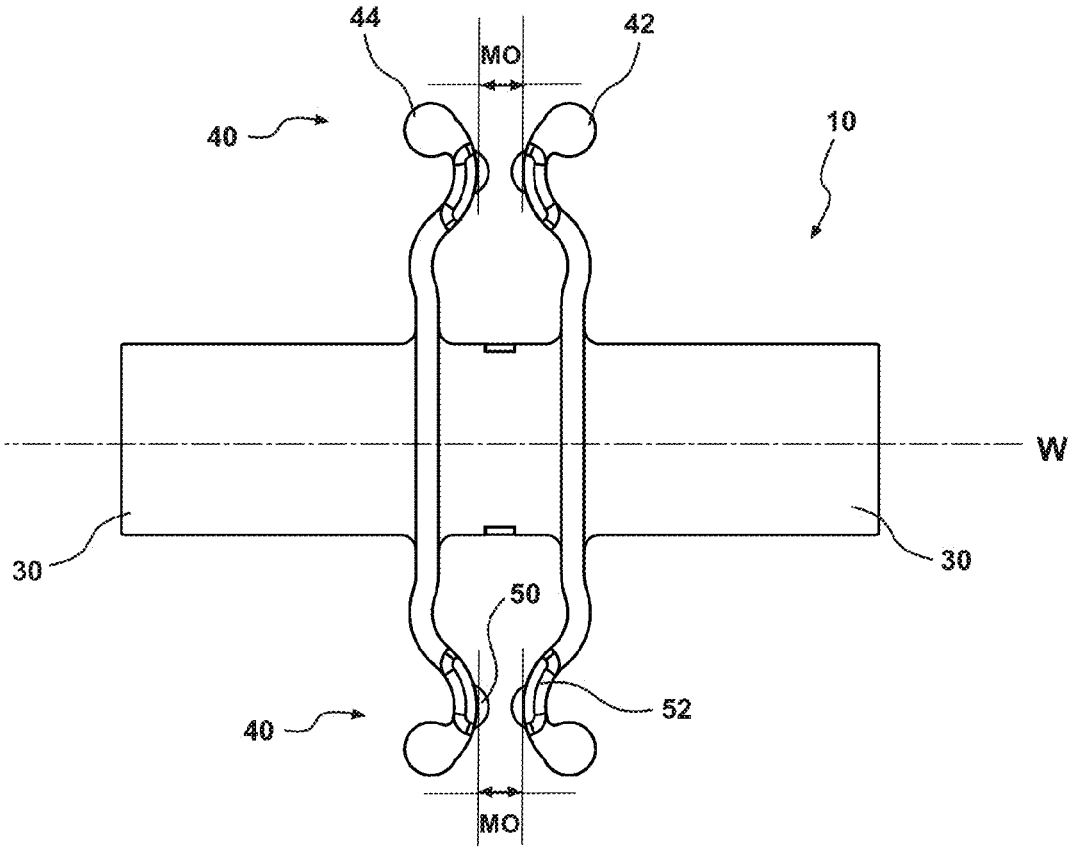
FIG. 4*c* is an underneath plan view of the shooting aid shown in FIG. 3*a;*

As mentioned previously, the connection member 40 includes the two connection portions 42, 44 that are configured to enable the shooting aid 10 to be clipped onto the rib 104 of the shotgun 100. In accordance with the illustrated embodiment, the two connection portions 42, 44 extend forward and rearward of the wing 30 and as shown in FIG. 4*c* are each symmetrical about a longitudinal central axis W of the wing 30. The two members 42, 44 define a minimum opening MO (FIGS. 4*b* and 4*c*) therebetween, which is less than the width of the rib 104. Due to the symmetrical nature of the two connection portions 42, 44 and that they extend both forward and rearward of the wing 30, there is a zone of minimum opening MO forward of the wing 30 and a zone of minimum opening MO rearward of the wing 30. Having two such zones and having them located either side of the wing 30 is advantageous at it prevents inadvertent twist of the shooting aid 10 and further helps to properly connect the shooting aid 10 to the rib 104 of the shotgun 100. At least some part of one or both of the connection portions 42, 44 is resiliently flexible to enable the minimum opening MO between the members 42, 44 to be expanded (i.e. to form an expanded opening as shown in FIG. 1) so as to allow the rib 104 to be located there between. The width of the rib 104 may vary but is typically within the range of 8-15 mm. Therefore by having the connection portions 42, 44 resiliently deformable or biased the connection member 40 can accommodate various width ribs 104.

In accordance with the illustrated embodiment, the distal parts of each connection portion 42, 44 extending rearward and forward of the wing 30 are resiliently flexible so as to have some degree of "spring". When the rib 104 is located between the connection portions 42, 44, at least a part of each connection portion 42, 44 adjacent the expanded opening presses against the rib 104 and thereby holds the shooting aid 10 to the rib 104 of the shotgun 100. The part of the connection portion 42, 44 that contact the rib 104 are configured to provide sufficient sideways return force on the rib 104 to connect and hold the shooting aid 10 in position on the shotgun 100 during use thereof. When the shooting aid 10 is mounted on the rib 104, the shooting aid 10 should be centred about the longitudinal central axis of the barrel 102 of the shotgun 100.

Figure 5A:
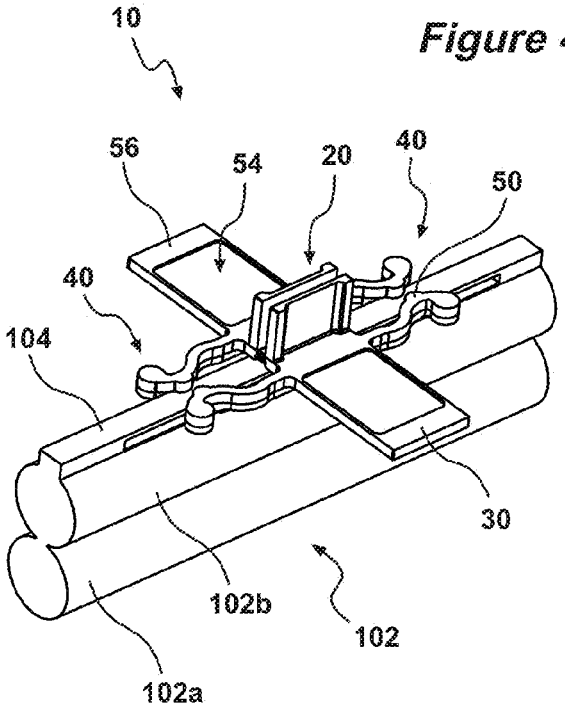
FIG. 5*a* is an isometric view of the shooting aid attached to a rib of an over and under double barrel shotgun.
Figure 5B:
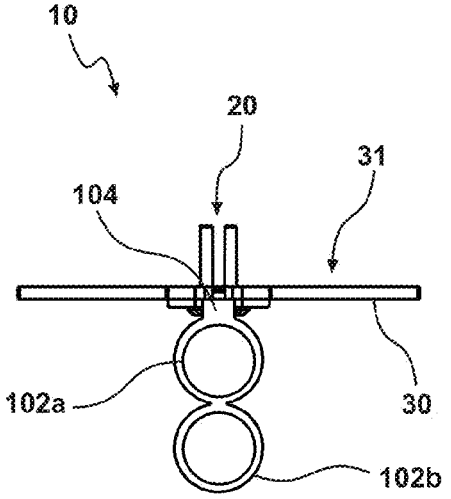
FIG. 5*b* is a front, end view of the shooting aid attached to the gun of FIG. 5*a;*
Figure 5C:
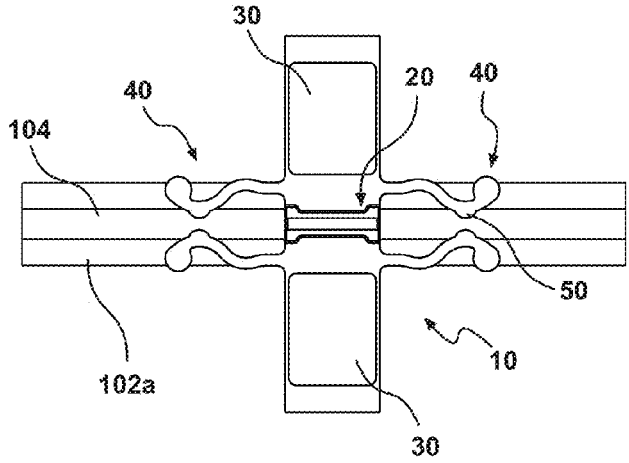
FIG. 5*c* is a top view of the shooting aid attached to the gun of FIG. 5*a;*

FIGS. 5*a* to 5*c* illustrate an over and under type double barrel shotgun 100 having and upper barrel 102*a* and a lower barrel 102*b*. The shooting aid 10 is attached to the rib 104 that extending down the length of the upper barrel 102*a*. FIGS. 5*a* and 5*b* clearly illustrate how the projections 50 bear onto the top of the rib 104. Since projections 50 are formed on the connection members 40 on both ends of the sight channel 20 the shooting aid 10 is inhibited from tilting longitudinally in the direction of the rib 104. It also ensures correctly attachment of the shooting aid 10 to the top of the rib 104 since the user can push the shooting aid 10 down onto the rib 104 until it comes to a stop as a result of the projections 50 abutting the rib 104.

FIG. 5*c* illustrates how the shooting aid 10 is centred on the rid 104 when attached, to ensure the central longitudinal axis L of the sight channel 20 is coaxially aligned with a central longitudinal line of the rib 104. This means that when the shooter looks down the length of the rib 104 they will be able to observe the bead 105 through the sight channel 20 when the gun 100 is held in a correct position.

Figure 7A:
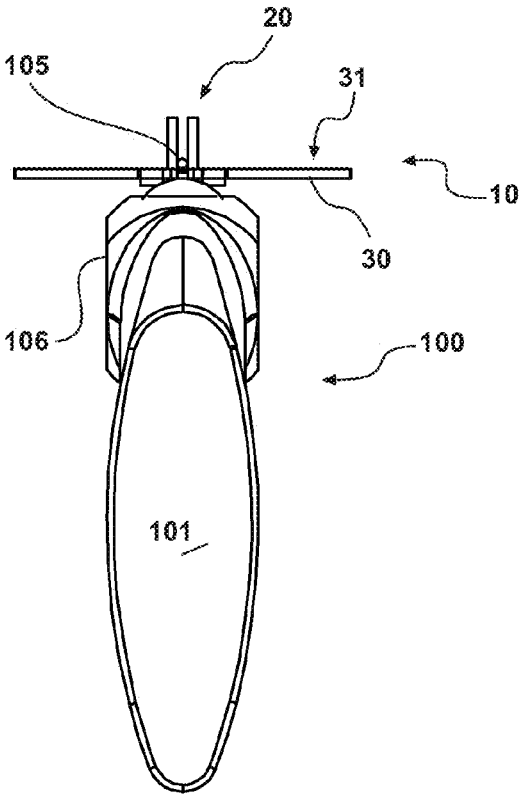
FIG. 7*a* is a rear end view of the shotgun illustrating a correct sight picture and orientation of the shotgun.

FIGS. 6*a* to 6*d* illustrate the shooting aid 10 attached to a rib 104 of a side-by-side double barrel shotgun 100, which includes barrel 102*a* beside barrel 102*b*. As clearly illustrated in FIG. 6*b* the tapered protrusions 52 avoid contact with the barrel 102*a* and 102*b*. The sight channel 20 is provided to establish a correct view of the target only when the shotgun 100 is correctly mounted and with the shooter's dominant eye properly focussed on the target. In this position, the shooter's dominant eye will see through the sight channel 20 to the front bead 106 of the barrel 102 of the shotgun 100, as previously discussed with respect to FIG. 2*b*. If this can be achieved, the shooter's eye is considered to be positioned correctly horizontally. When the shooter's dominant eye is also positioned correctly vertically, the front bead 106 will appear to sit atop the base 22 of the sight channel 20. Thus it will be appreciated that the sight channel 20 can be used to ensure correct positioning of the shooter's eye both vertically and horizontally and this establishes what will later be referred to as the first and second of the three references that can be assessed using a shooting aid according to an embodiment of the invention. FIG. 7*a* illustrates the sight picture seen by the shooter when correct gun mount is achieved. The reader will appreciate that FIGS. 7*a* and 7*c* to 7*f* do not show just the shooter's sight picture but also illustrate the overall rear view and orientation of the gun.

Figure 7B:
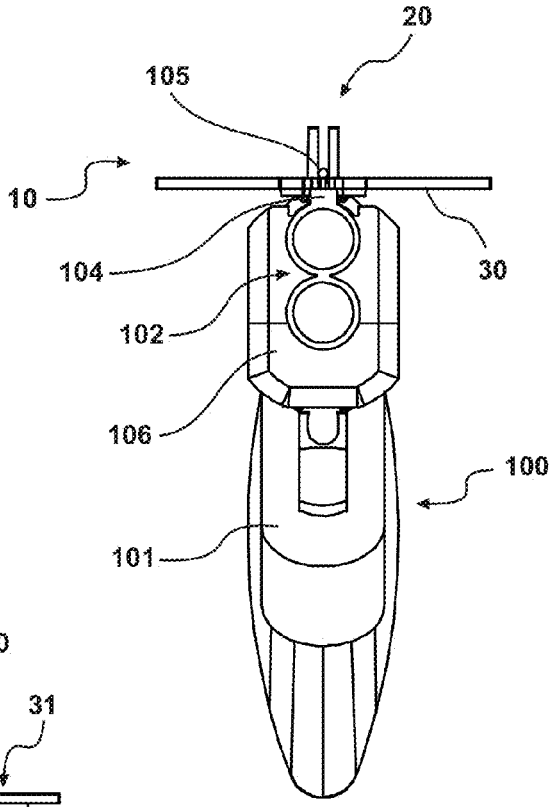
FIG. 7*b* illustrates the desired orientation with correct gun fitted as viewed down the barrel by the gun fitter (not shooter)

The shooting aid 10 can also be used by the gun fitter to check gun-fit. The gun fitter can look back down the barrel and see the shooter's eye between the first and second inner sides 24, 26 of the sight channel 20. The gun fitter would view the shooting aid 10 as per FIG. 7*b* and would also be able to view the shooter's eye. A gun fitter can therefore look back down the barrels (with an unloaded gun) or the shooter can self access with the shooting aid 10.

If the shooter can comfortably adopt a gun mount enabling the front bead 106 to be sighted sitting atop the base 22 of the sight channel 20, acceptable gun-fit is considered to be achieved. Accordingly, gun-fit should be adjusted (requiring adjustments to be made to the shotgun) until this can be achieved and in this manner the shooting aid 10 can be used to assess and ultimately confirm acceptable gun-fit for a shooter with that particular shotgun 100.

Once acceptable gun-fit is established, the shooting aid 10 can be used to help teach correct gun mount by examination of three assessment references that need to be correctly positioned.

The sight channel 20 can be used to teach proper horizontal and vertical positioning of the dominant eye along the barrel 102 and relative to the front bead 106 and thus the first and second assessment references. Further, the upper faces 31 of the wing 30 can be used to teach the proper vertical orientation of the shotgun 100 against the shooter's body. Irrespective of the angle at which the target is located relative to the shooter's position, the gun mount should always be such to ensure that the vertical axis of the shotgun 100, that is the axis corresponding to a central longitudinal axis of the butt plate or stock 101 of the shotgun 100, is not rolled sideways away from the vertical. The shooting aid 10 provides a mechanism for the shooter to assess whether their shotgun 100 is rolled sideways when mounted by examination of the positioning of the wing 30, and more particularly the positioning of the upper faces 31 of the wing 30, which also forms part of their sight picture when their dominant eye is focussing on the target. If the upper faces 31 of the wing 30 are viewed as a single line which extends horizontally referenced to the horizon, the shooter will know that their shotgun 100 is not rolled sideways and their gun mount is correct for shooting. However, if the upper faces 31 of the wing 30 do not appear as a single line or do not appear as a single line extending horizontally referenced to the horizon, they will know that their shotgun 100 is incorrectly mounted. They then need to adjust the positioning of their shotgun 100 (i.e. adjust their gun mount) until the upper faces 31 of the wing 30 are seen as a single line extending horizontally referenced to the horizon.

Figure 7C:
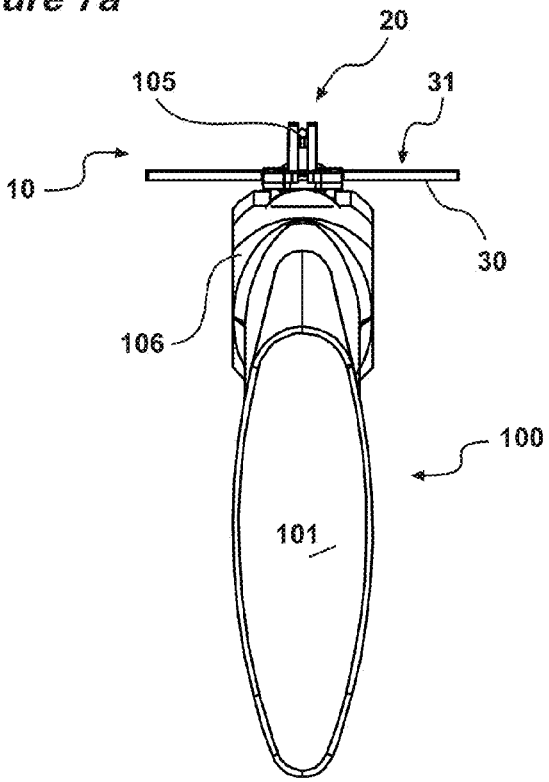
FIG. 7*c* is a rear end view of the shotgun illustrating an incorrect sight picture with eye high.
Figure 7D:
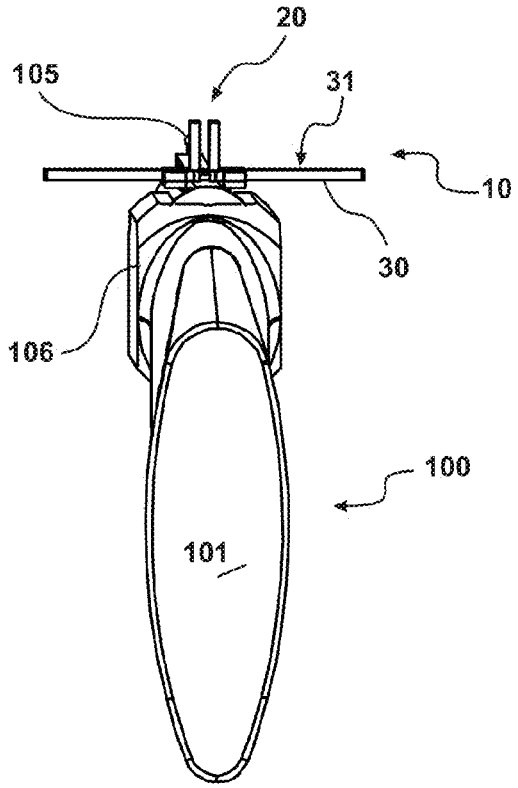
FIG. 7*d* is a rear end view of the shotgun illustrating an incorrect sight picture with eye high and to the left.
Figure 7E:
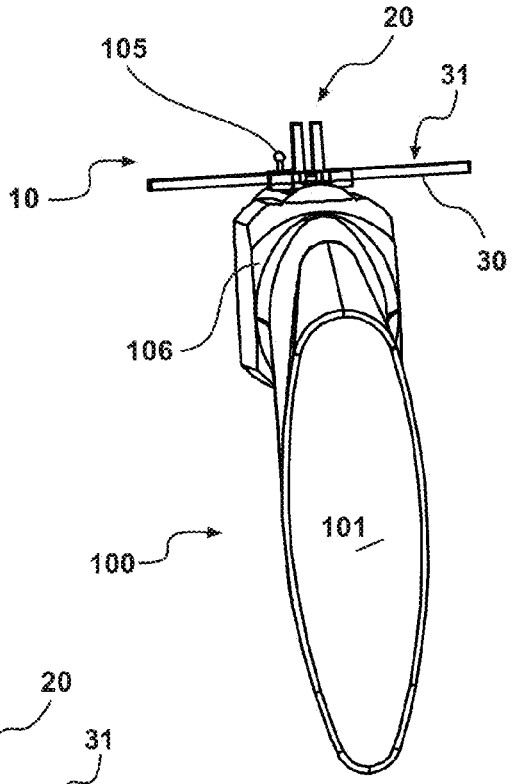
FIG. 7*e* is a rear end view of the shotgun illustrating an incorrect sight picture with eye left and canted left.
Figure 7F:
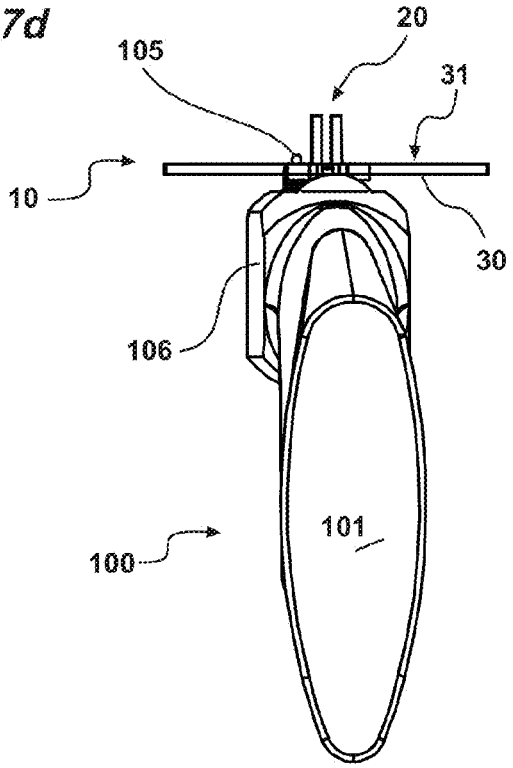
FIG. 7*f* is a rear end view of the shotgun illustrating an incorrect sight picture with eye left.

FIGS. 7*a* and 7*c* to 7*f* depict examples of possible different sight pictures that could be seen by a shooter using the shooting aid 10 depending on the positioning of their gun and their dominant eye relative to the sight channel 20. FIG. 7*a* illustrates a correct sight picture and reflects what the shooter would see when they have their eyes correctly focussed on the target and their gun correctly mounted. FIG. 7*c* is an example of an incorrect sight picture, this sight picture is achieved when the shooter's dominant eye is located high. FIG. 7*d* is another example of an incorrect sight picture, this sight picture is achieved when the gun the shooter's dominant eye is located high and to the left. FIG. 7*e* is a further example of an incorrect sight picture, this sight picture is achieved when the gun is tilted to the left and the dominant eye is to the left and slightly high. FIG. 7*f* is a still further example of an incorrect sight picture, this sight picture is achieved when the dominant eye is to the left but at the correct height.

It will be appreciated that a user of the shooting aid 10 could be shown various exemplary sight picture images to explain to them the differences between a correct and incorrect sight picture. This knowledge could then be used by the shooter to compare the sight picture they actually see when using the shooting aid 10 with the images previously shown to them. This enables the shooter to readily understand what sight picture they are aiming to achieve and also how to move their gun and eye to achieve the correct sight picture. Again, it will be understood by a person skilled in the art that the correct sight picture may vary somewhat depending on the discipline of shooting in question. The skilled addressee will appreciate that the phase "sight picture" used throughout the specification relates to the view that the shooter has at any given moment in time.

By using the shooting aid 10 to repeatedly check each of the three references after the shooter has mounted their gun, the shooter can be conditioned through muscle memory training to consistently mount their gun to the same correct position. To this end, it is envisaged that the shooter would correctly mount their gun with the assistance of the shooting aid 10, they would then try to repeat that motion with their eyes closed and would open their eyes and check their gun mount positioning with the shooting aid 10. This process would be repeated until proper gun mounting can be consistently achieved. This will later facilitate the shooter's ability to reliably hit targets, whether moving or stationary because they will adopt, without conscious thought, a correct gun mount whilst retaining focus on the target.

Using the shooting aid 10 also allows the shooter to train with both eyes wide open rather than squinting the non-dominant eye. This helps to achieve best view and focus on the target. One drill used by shotgun shooters to improve their shooting is to have both eyes wide open and to train the eyes not to see double. Stereo vision is important to correctly judge speed and distance and so having both eyes wide open is advantageous.

It is envisaged that the shooting aid 10 would only be used during shooting training and for this reason the described embodiments include a connection member enabling removable connection of the shooting aid 10. However, other forms of connection (e.g. permanent) may be adopted.

In accordance with an embodiment of the invention the wing 30 of the shooting aid 10 may be demountable from the sight channel 20.

Figure 8:
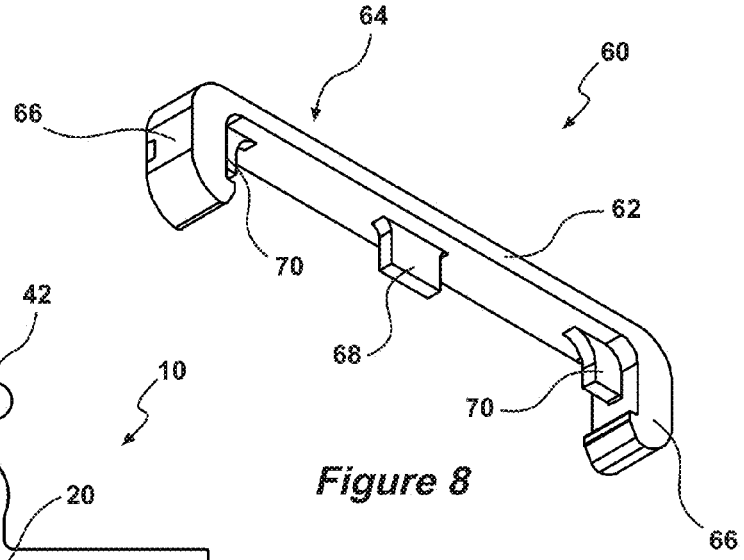
FIG. 8 is an isometric view of a shim or insert used to raise the base or floor of the sight channel.

FIG. 8 illustrates an enlarged view of a shim or insert 60 that can be used to raise the base or floor 22 of the sight channel 20.

This is important in different situations such as when clay targets are being fired straight up in front of the shooter. In these situations it is necessary to vary to pattern percentages and the point of impact (POI) being the actually centre of the shot pattern. With such fast moving targets that are being fired vertically up in front of the shooter a percentage other than the standard 50%, i.e. the POI at the centre of the shot pattern may be desirable. For rising (vertically) targets it is sometimes desired that the pattern POI is above the sighting point, for example 70% above and 30% below commonly referred to as 70/30. One reason is that the gun barrel will obscure the target that is rising from below. Therefore with a, for instance, 70/30 pattern the shooter will see the area where the target will be hit. This is not the case when the target is 'crossing' that is it is essentially moving horizontally. A discipline such as trap shooting has predominantly rising targets and shooters often will setup their gun fit to achieve this 70/30 or similar pattern.

The use of the shims or inserts 60 allows the shooter to adjust the vertical aim point of the shotgun to obtain the desired sight picture. Shims allow the gun aiming POI to be moved up with the same sight picture (i.e. the bead at the bottom of the slot). Adding a shim will require the eye to be raised to see the same sight picture, which will drop the rear of the gun and cause the barrels to rise, which raises the POI.

Figure 9A:
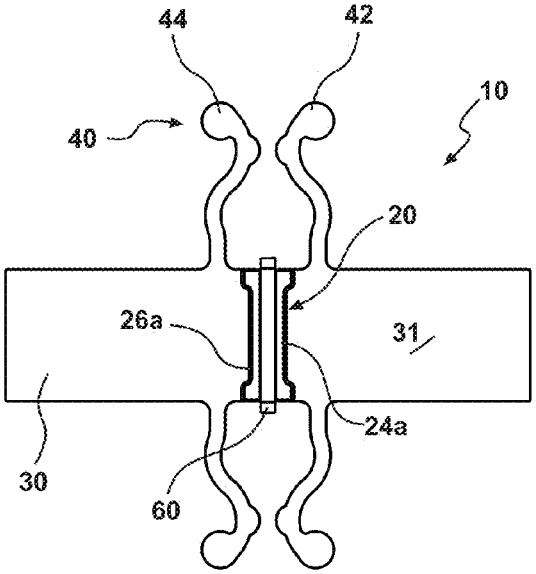
FIG. 9*a* is a top view of the shooting aid with the shim or insert installed within the sight channel.
Figure 9B:
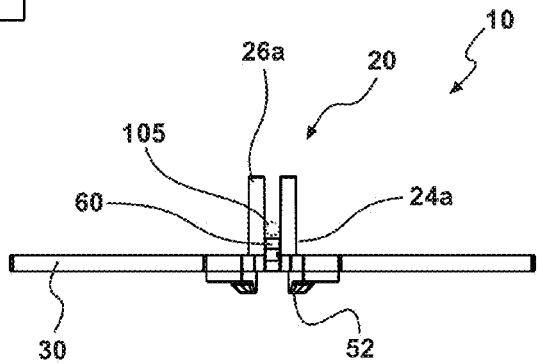
FIG. 9*b* is an end view of the shooting aid of FIG. 9*a* with the shim or insert installed.

The shim 60 includes a longitudinally extending main portion 62 that includes an upwardly facing surface 64 when the shim 60 is installed within sight channel 20. Engagement members 66 are located at opposite ends of the portion 62 and are configured to clip over the edge of the base 22, as illustrated in FIGS. 9*a* and 9*b*. The shim 60 includes depending lugs 68 and 70 that abut the surface of the base 22 to ensure it is parallel therewith. FIG. 9*b* also illustrates the position that the bead 105 will be located with a correct sight picture.

Figure 10A:
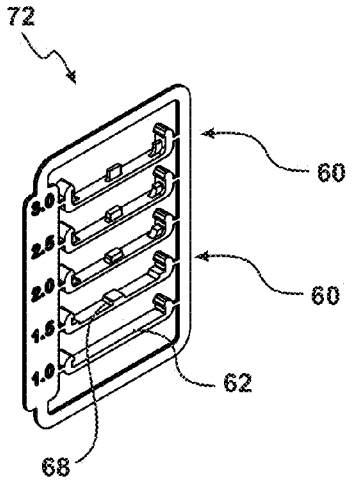
FIG. 10*a* is an isometric view of a set comprising a plurality of removable different sized shims or inserts used to raise the base or floor of the sight channel by various degrees.
Figure 10B:
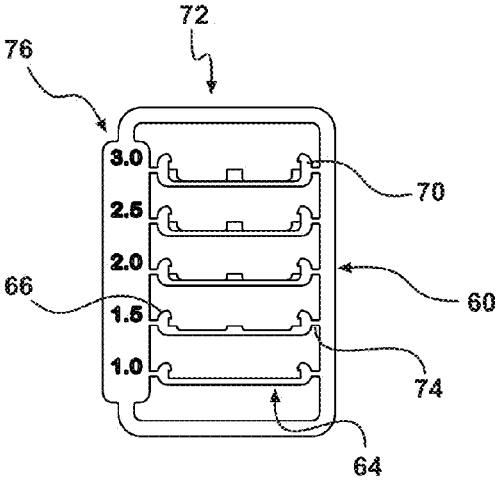
FIG. 10*b* is a front view of a shim set of FIG. 10*a* illustrating the various sized shims or inserts.

FIGS. 10*a* and 10*b* illustrate a shim set 70 including a number of different sized shims 60 to effectively raise the lower horizontal surface of the sight channel 20. In the present embodiment the shim set 70 includes five different sized shims 60 held within frame 76 by frangible web members 74. The frame 76 also includes marking indicating the size of each of the shims 60.

Although the embodiments have been described in relation to use on a shotgun 100, it is envisaged that the invention may have application with other forms of firearms. Accordingly, it should be appreciated that the invention is not intended to be restricted for use on shotguns and modifications of the invention to enable adaptation to other forms of firearms is envisaged and within the scope of the present invention. The claims should also be considered and understood in this broader context and the term "gun" given a meaning to include such applications.

The reader will appreciate that the present invention provides a detachable aid, which provides a tool for gun fit and a training aid for gun mount to train the muscle memory of the shooter.

The embodiments have been described by way of example only and modifications within the spirit and scope of the invention are envisaged.

What is claimed is:

1. A gun mount training method for a shooter using a shooting aid comprising a sight channel; a wing; and a connection member for connecting the shooting aid to the gun; wherein the sight channel has a central vertical axis that extends substantially perpendicularly to an upper plane of the wing, said method including the steps of:

a) the shooter mounting their gun to correct gun mount identified by using the shooting aid;

b) removing their gun from the correct gun mount and then attempting to return their gun to correct gun mount without use of the shooting aid; and c) checking their gun mount with the shooting aid to establish whether correct gun mount had been achieved.

2. The gun mount training method according to claim 1, further including the step of adjusting gun mount using the shooting aid to correct gun mount if appropriate gun mount was not found to have been previously established.

3. A gun-fit assessment method for a shooter using a shooting aid, said shooting aid including a sight channel, a wing and connection member for connecting the shooting aid to the gun, and wherein the sight channel has a central vertical axis that extends substantially perpendicularly to an upper plane of the wing, said method including the steps of:

a) the shooter mounting their gun in a position where the front bead of the gun is sighted atop a base of the sight channel; and b) the shooter assessing whether he is physically comfortable when his gun is in that position.

4. The gun-fit assessment method according to claim 3, further including the step of:

c) adjusting the gun if the shooter assessed he was physically uncomfortable in that position:

d) remounting the adjusted gun so that the front bead of the gun is sighted atop the base of the sight channel of the shooting aid; and e) the shooter assessing whether he is physically comfortable when his adjusted gun is in that position.

5. The gun-fit assessment method according to claim 4, further including repeating steps c), d) and e) until the shooter is physically comfortable when his gun is in a position with the front bead of the gun sighted atop the base of the sight channel of the shooting aid.

* * * * *